US007104196B1

(12) United States Patent
Fong et al.

(10) Patent No.: US 7,104,196 B1
(45) Date of Patent: Sep. 12, 2006

(54) MARKER ASSEMBLY, MARKING METHOD, AND KIT

(76) Inventors: Alexander W. Fong, 2678 College Hill Cir., Schaumburg, IL (US) 60173-5756; Albert F. Ditzig, 1155 Mayfield La., Hoffman Estates, IL (US) 60195

( * ) Notice: Subject to any disclaimer, the term of this patent is extended or adjusted under 35 U.S.C. 154(b) by 0 days.

(21) Appl. No.: 11/243,219

(22) Filed: Oct. 4, 2005

(51) Int. Cl.
*B41F 5/00* (2006.01)
*B41F 13/10* (2006.01)

(52) U.S. Cl. ..... 101/328; 101/106; 101/109; 101/329; 101/375; 101/376

(58) Field of Classification Search ..... 101/328, 101/329, 376, 375, 106; 10/109
See application file for complete search history.

(56) References Cited

U.S. PATENT DOCUMENTS 2,887,952 A * 5/1959 Gottscho et al. ..... 101/367
3,094,105 A 6/1963 Jenkins
3,537,394 A * 11/1970 Swapp ..... 101/328
3,705,774 A 12/1972 Kranich
4,593,618 A * 6/1986 Lebensfeld ..... 101/375
4,692,046 A 9/1987 Lan
5,303,648 A * 4/1994 Shih ..... 101/329
5,352,282 A 10/1994 Miller
5,383,736 A 1/1995 Okulov
5,435,245 A * 7/1995 Salisbury et al. ..... 101/328
5,732,627 A * 3/1998 Imamaki ..... 101/328
6,056,463 A 5/2000 Nishio et al.
6,360,658 B1 * 3/2002 Benson ..... 101/109
6,659,001 B1 * 12/2003 Toyama ..... 101/106

* cited by examiner

*Primary Examiner*—Andrew H. Hirshfeld
*Assistant Examiner*—Marvin P Crenshaw
(74) *Attorney, Agent, or Firm*—Meroni & Meroni, P.C.; Charles F. Meroni, Jr.; Christopher J. Scott

(57) ABSTRACT

A rolling marker assembly enables a user to mark serially-presented, repeating patterns upon a marking surface. The marker assembly comprises an outer casing and a marking caster assembly. The marking caster assembly comprises at least one compressible medium-dispensing pad and at least one pad mask. The pad mask comprises at least one patterned aperture. The medium-dispensing pad is impregnated with a compression-releasable marking medium. The caster assembly is rotatable about an axis of rotation and the medium-dispensing pad is compressible against the pad mask thus forming at least one pattern-exposed pad portion adjacent the patterned aperture. The marker assembly is manually traceable adjacent a marking surface and the pattern-exposed pad portion is compressible upon the marking surface for dispensing the marking medium therefrom for marking a pattern upon the marking surface. The casing enables the user to more effectively guide and compress the caster assembly for marking the pattern(s).

20 Claims, 10 Drawing Sheets

MARKER ASSEMBLY, MARKING METHOD, AND KIT

BACKGROUND OF THE INVENTION

1. Field of the Invention

The present invention generally relates to a certain writing implement or marking implement for generating serially-presented, repeating patterns upon a marking surface. More particularly, the present invention relates to a rolling marker assembly, marking method(s) achieved thereby, and a kit for enabling a user to construct selectively multi-colored patterns upon a marking surface.

2. Description of the Prior Art

The state of the art relating to writing implements and/or other marking implements is well developed. A search into the state of the art reveals that a number of multi-colored marking implements are known in the prior art. Some of the more pertinent prior art relating to multi-colored marking implements and the like is briefly described, hereinafter.

U.S. Pat. No. 3,094,105 ('105 patent), which issued to Jenkins, discloses a Pen. The '105 patent teaches a writing device adapted to contain a plurality of separated fluids which are mixed upon discharge. The device comprises an elongated hollow body portion having opposite ends; certain removable closure means sealing one end of the body portion; a ball-mounting aperture formed in the opposite end of the body portion, a ball rotatably mounted in the aperture; and means disposed within the body portion providing at least two reservoirs, each reservoir being adapted to contain a different fluid and to maintain its fluid separated until the user draws or traces the ball against a marking surface, during which process the fluids are discharged from the reservoirs and mixed for marking a pattern upon the marking surface.

U.S. Pat. No. 3,705,774 ('774 patent), which issued to Kranich, discloses a Writing Instrument. The '774 patent teaches a ball point pen having a plurality of writing members, each containing a different colored ink. A writing member is selected by depressing a pressure member, inclining the instrument in a certain direction and then releasing the pressure member.

U.S. Pat. No. 4,692,046 ('046 patent), which issued to Lan, discloses a Pen with Selective Multi-Color Cores. The '046 patent teaches a pen containing multi-color cores located in different tubes housed in the pen body, which colors can be optionally selected for use readily using a specially-designed turnable knob having a projected edge in cam contact with the top end of the core-receiving tubes. The top end of the core-receiving tube is pushed downward for use, when the turnable knob is rotated, so to enable a person to select a color core as he wishes quickly and readily.

U.S. Pat. No. 5,352,282 ('282 patent), which issued to Miller, discloses Color Changing Compositions. The '282 patent teaches a multiple coloring composition system, the coloring effect of which is changed upon treatment with a second coloring composition, once the second coloring composition has been deposited over the first coloring composition. The multiple ink system comprises: (a) a first aqueous coloring composition comprising a first dye whose coloring ability is destroyed in the presence of a bleach; and (b) a second aqueous coloring composition comprising from about 1% to about 20% by weight of a bleach; and from about 0.1% to about 12% by weight of a colorant capable of maintaining its characteristic color in the presence of a bleach and/or a pH of about 10 or greater. The multiple coloring composition may further comprise a base in an amount sufficient to elevate the pH of the second aqueous coloring composition to a level of from about 10 to about 12.

U.S. Pat. No. 5,383,736 ('736 patent), which issued to Okulov, discloses a Writing Instrument with Plural Feeds. The '736 patent teaches a writing instrument including a body having at its distal end a saddle portion in which a writing element, for example a ball, is placed, and a feeding element with a plurality of channels through which mixing components may pass for application to a surface by the writing element. The feeding element is configured with the body so that the body is rotatable about the feeding element. There is provided at least one opening or passageway in the body position between the feeding element and the writing element wherein the mixing of the components takes place.

U.S. Pat. No. 6,056,463 ('463 patent), which issued to Nishio et al., discloses an Aqueous Ballpoint Pen Refill and Process for Producing the Same. The '463 patent teaches an aqueous ballpoint pen refill which can produce tasteful writings or drawings with a plurality of colors and which gives an attractive impression, since the inks in the ink reservoir constitute an interesting pattern and also a process for producing the same. A plurality of aqueous inks Ia and Ib with different colors are charged into an ink reservoir having a point tip at the front end to form a vertical or horizontal layered structure or a spiral structure; the aqueous inks containing pigments as coloring agents respectively and each having a viscosity of 45 mPa.multidot.S or more; the specific gravity difference of the inks being not more than 0.05. Injection needles connected respectively to front ends of a plurality of ink tanks are inserted to the transparent ink reservoir, and the plurality of inks with different colors are injected while the injection needles are drawn out of the ink reservoir.

It will be seen from a further review of the above-referenced patents and other prior art generally known to exist, however, that the prior art does not teach a rolling marker assembly, nor does the prior art teach certain marking methodology as inherently taught by a rolling marker assembly. The prior art further does not teach or a rolling marker assembly kit for enabling a user to mark multi-colored, serially-presented, repeating patterns upon a marking surface. The prior art thus perceives a need for a rolling marker assembly, marking method, and rolling marker assembly kit for enabling a user to mark multi-colored, serially-presented, repeating patterns upon a marking surface.

SUMMARY OF THE INVENTION

Accordingly, it is an object of the present invention to provide a rolling marker assembly for enabling a user to mark multi-colored, serially-presented, repeating patterns upon a marking surface. The rolling marker assembly summarily comprises a hand-holdable outer shell casing and a caster assembly. The outer shell casing comprises an inner casing surface, an outer casing surface, a substantially circular transverse casing cross-section, a longitudinal casing axis, a casing height, and a casing rim. The caster assembly comprises a marker carriage, a rotating pen assembly, and a caster assembly length.

The marker carriage comprises a casing attachment member and certain pen assembly-receiving means. The pen assembly comprises an inner pen core assembly, a plurality of intermediate ink-dispensing pads, a plurality of outer ink-masking shells, and at least one marker rotation axis. The ink-masking shells each comprise a patterned aperture and an outer shell surface. Each ink-dispensing pad is impregnated with a select compression-releasable ink.

The rotating pen assembly is rotatably received by the marker carriage via the pen assembly-receiving means and thus is rotatable about the marker rotation axis. The caster assembly is rotatably attached to the casing and thus, is rotatable about the casing axis. The ink-dispensing pads are compressibly sandwiched intermediate the ink-masking shells and the pen core assembly and thus comprise or form pattern-exposed portions. The pattern-exposed portions extend through the patterned apertures and thereby comprise a substantially uniform exposed pad thickness. The difference between the caster assembly length and the exposed pad thickness is substantially equal to the casing height. The casing rim and the outer shell surfaces are manually traceable adjacent a marking surface. During manually tracing, the pattern-exposed portions are compressible upon the marking surface for dispensing ink therefrom. The rolling marker assembly thus enables the user to mark multi-color, serially-presented, repeating patterns upon the marking surface.

Other objects of the present invention, as well as particular features, elements, and advantages thereof, will be elucidated or become apparent from, the following description and the accompanying drawing figures.

BRIEF DESCRIPTION OF THE DRAWINGS

Other features of our invention will become more evident from a consideration of the following brief description of our patent drawings.

DETAILED DESCRIPTION OF THE PREFERRED EMBODIMENT(S)

Figure 1:
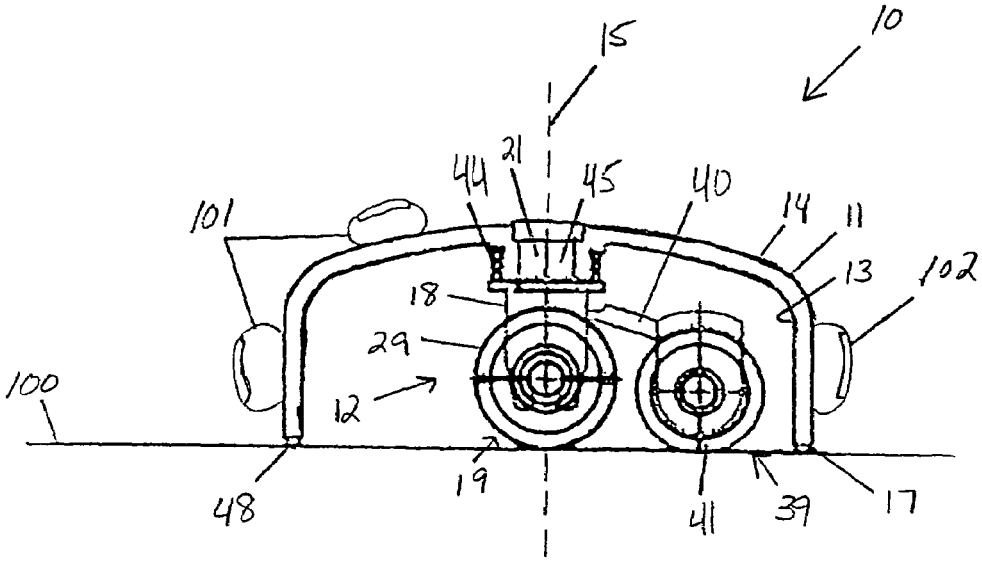
FIG. 1 is a fragmentary side view depiction of a first preferred embodiment of the rolling marker assembly as manually movable by hand adjacent a marking surface with certain parts broken away to show otherwise hidden internal structures.

Referring now to the drawings, the preferred embodiment of the present invention concerns a rolling marker assembly 10 or rolling marker assembly as generally illustrated and referenced in FIGS. 1–4. Rolling marker assembly 10 is designed to enable a user to mark serially-presented, repeating patterns upon a marking surface 100, which marking surface 100 is generally referenced in FIGS. 1, 2, 6, 8, 10, 14, and 15–17. The rolling marker assembly comprises a hand-holdable casing 11 or outer marker shell as illustrated and referenced in FIGS. 1–4, 6, 7, 9, 10, 11–13, and 15; and a caster type caster assembly 12 as generally referenced in FIGS. 1–4, 6, 8, and 10–12.

Figure 7:
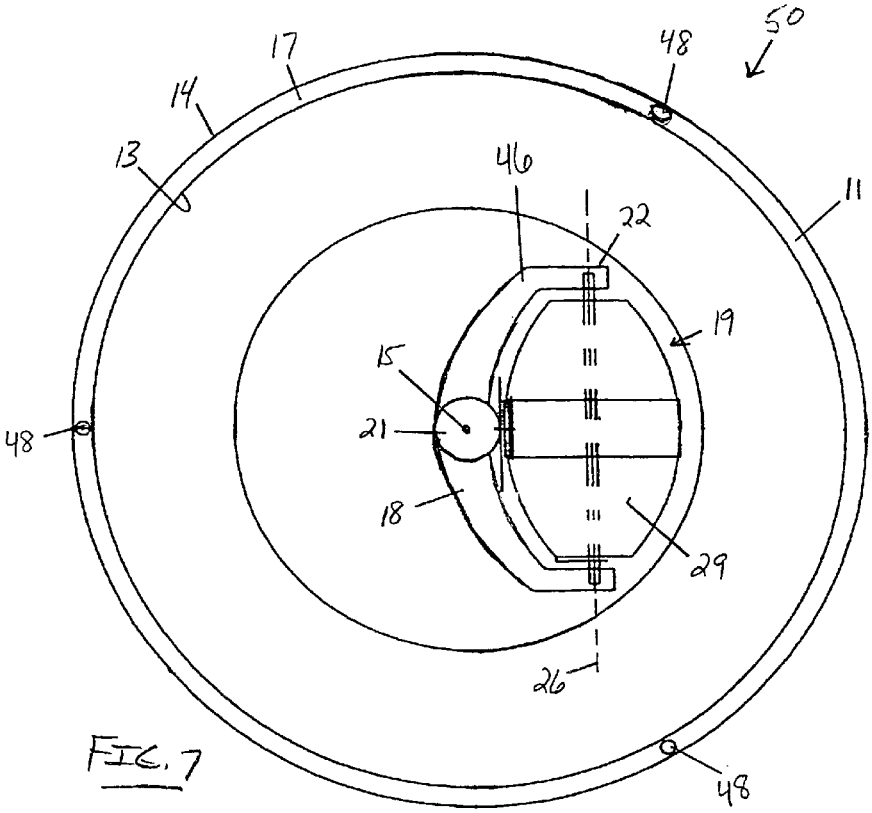
FIG. 7 is an enlarged bottom plan view of the first alternative embodiment of the rolling marker assembly showing the offset caster assembly comprising an alternative pen assembly.
Figure 8:
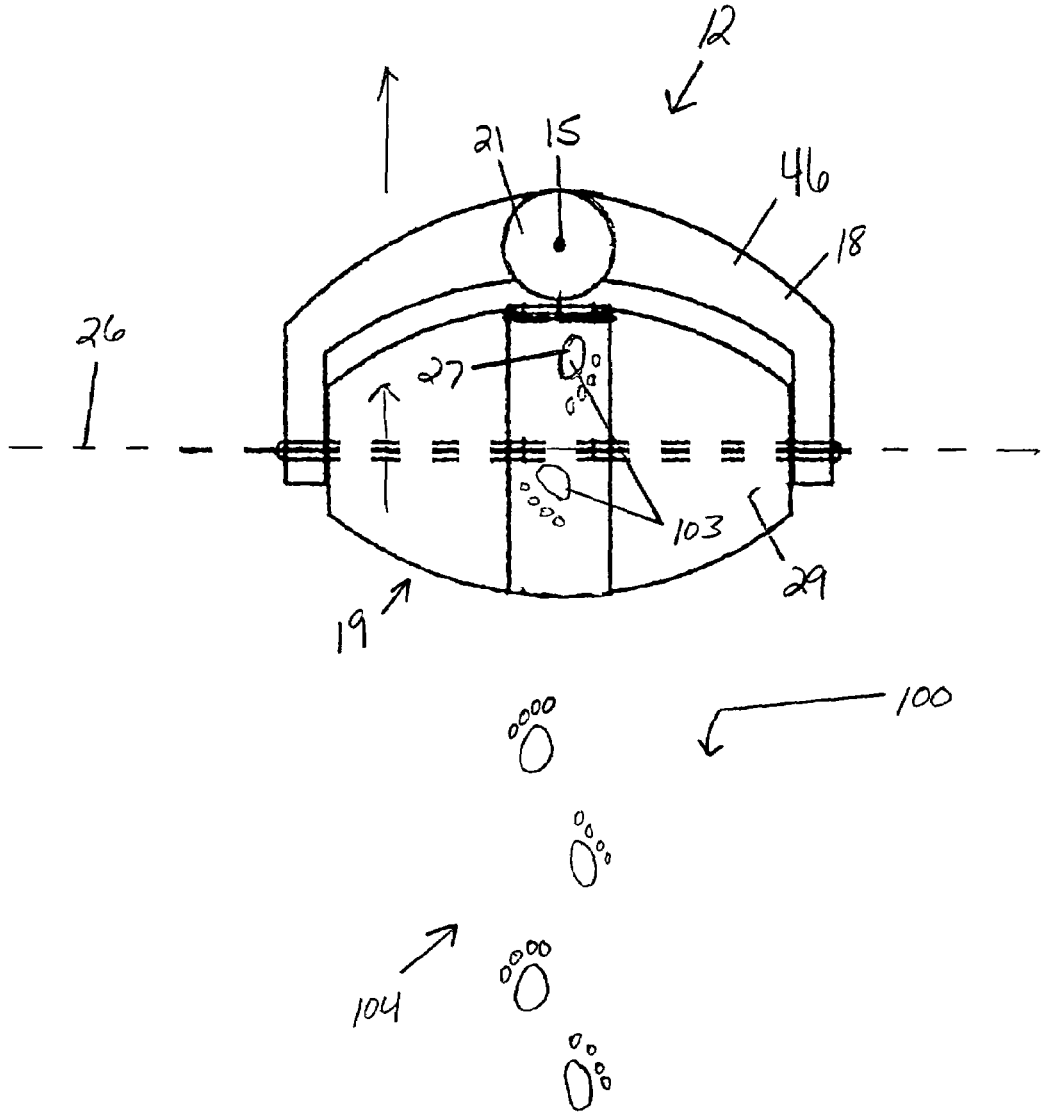
FIG. 8 is an enlarged bottom plan view of the offset caster assembly comprising the alternative pen assembly and a paw print pattern being marked upon the marking surface.
Figures 9, 10:
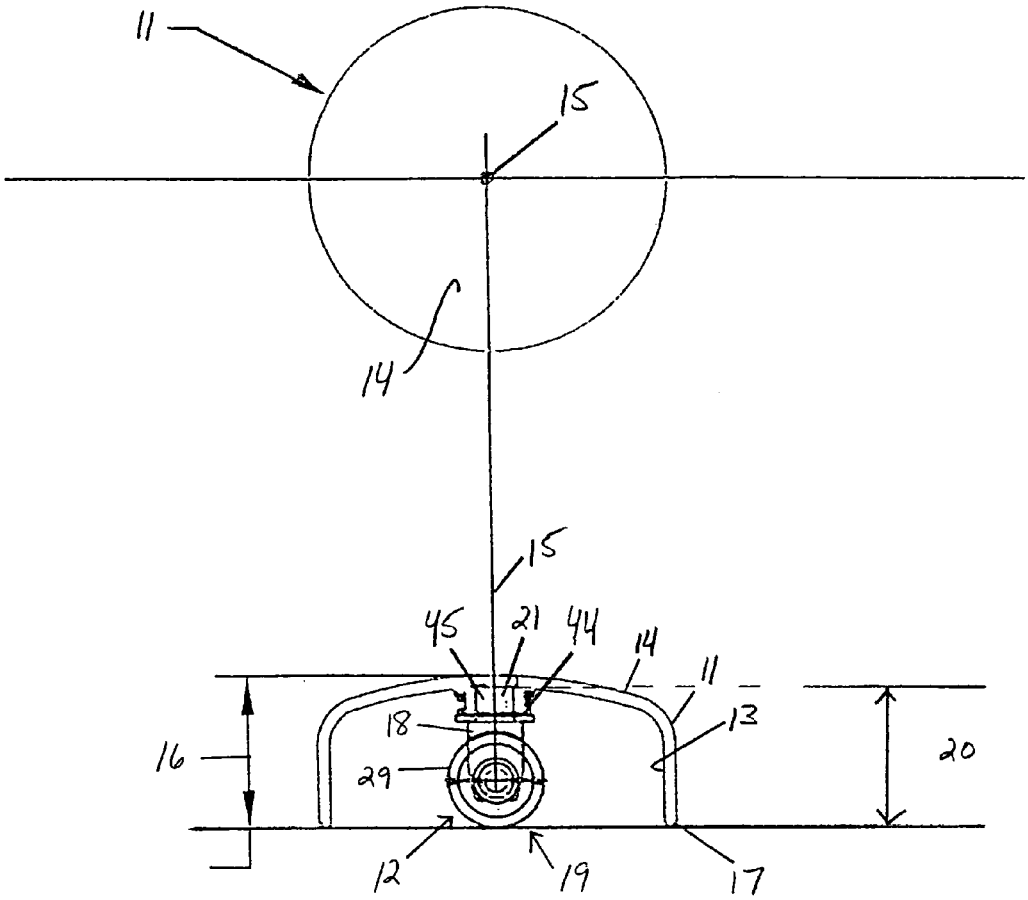
FIG. 9 is a top plan view of a second alternative embodiment of the rolling marker assembly showing a preferred outer shell casing.
FIG. 10 is a fragmentary side view depiction of the second alternative embodiment of the rolling marker assembly with parts broken away to show a unitary axial caster assembly.
Figure 11:
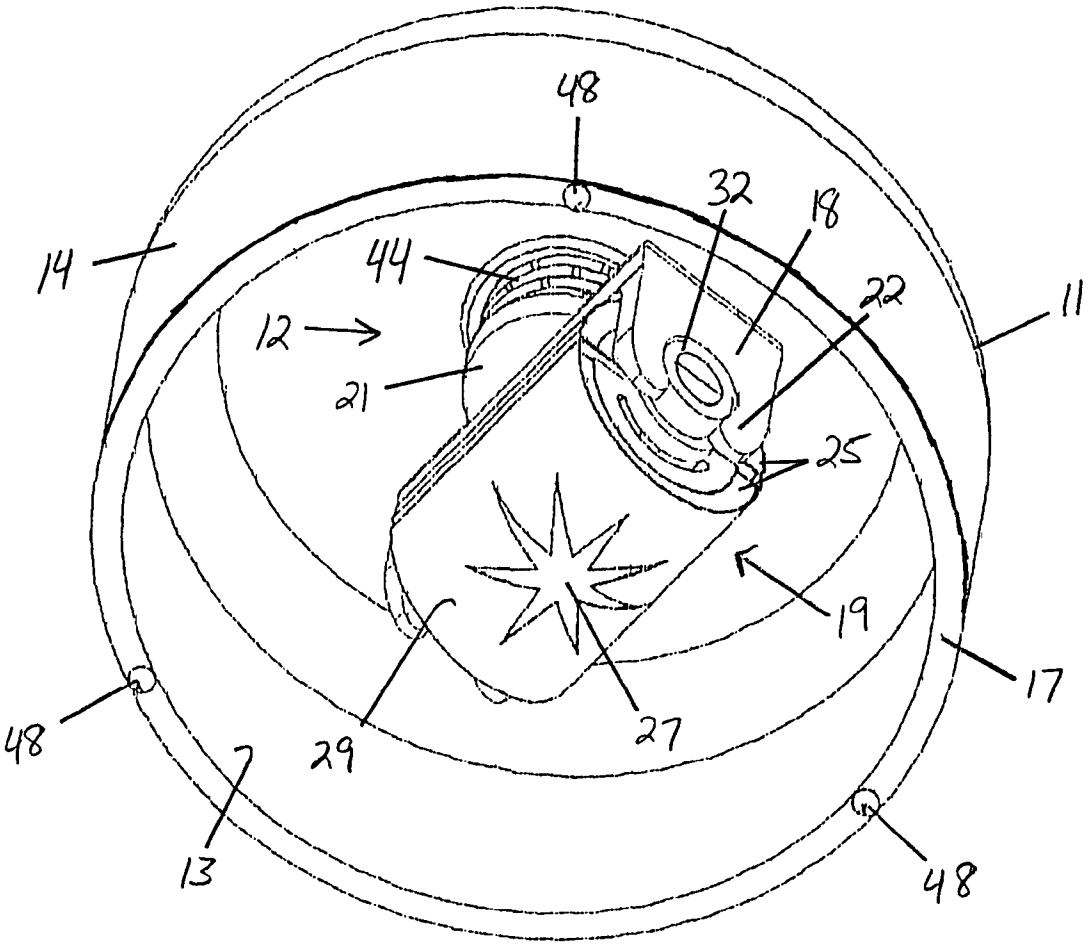
FIG. 11 is an enlarged bottom perspective view of the second alternative embodiment of the rolling marker assembly showing the unitary axial caster assembly radially inwardly adjacent to the outer shell casing.

Casing 11 preferably comprises a substantially circular transverse cross section as may be seen from a general inspection of the noted figures, and further inherently comprises an inner casing surface 13 as referenced in FIGS. 1–4, 6, 7, 10–13, and 15; an outer casing surface 14 as referenced in FIGS. 1–4, 6, 7, 9–13, and 15; a longitudinal casing axis 15 as generally referenced in FIGS. 1–4, 6–10, 16, and 17; a casing height 16 as generally depicted in FIG. 10; and a substantially coplanar casing rim 17 as generally referenced in FIGS. 1–4, 6, 7, 10, 11, 13, and 15. It will be seen from an inspection of FIG. 1 that casing 11 is sized and shaped to be received by a user's hand and is manipulatable by one's fingers 101 and thumb 102.

Figure 12:
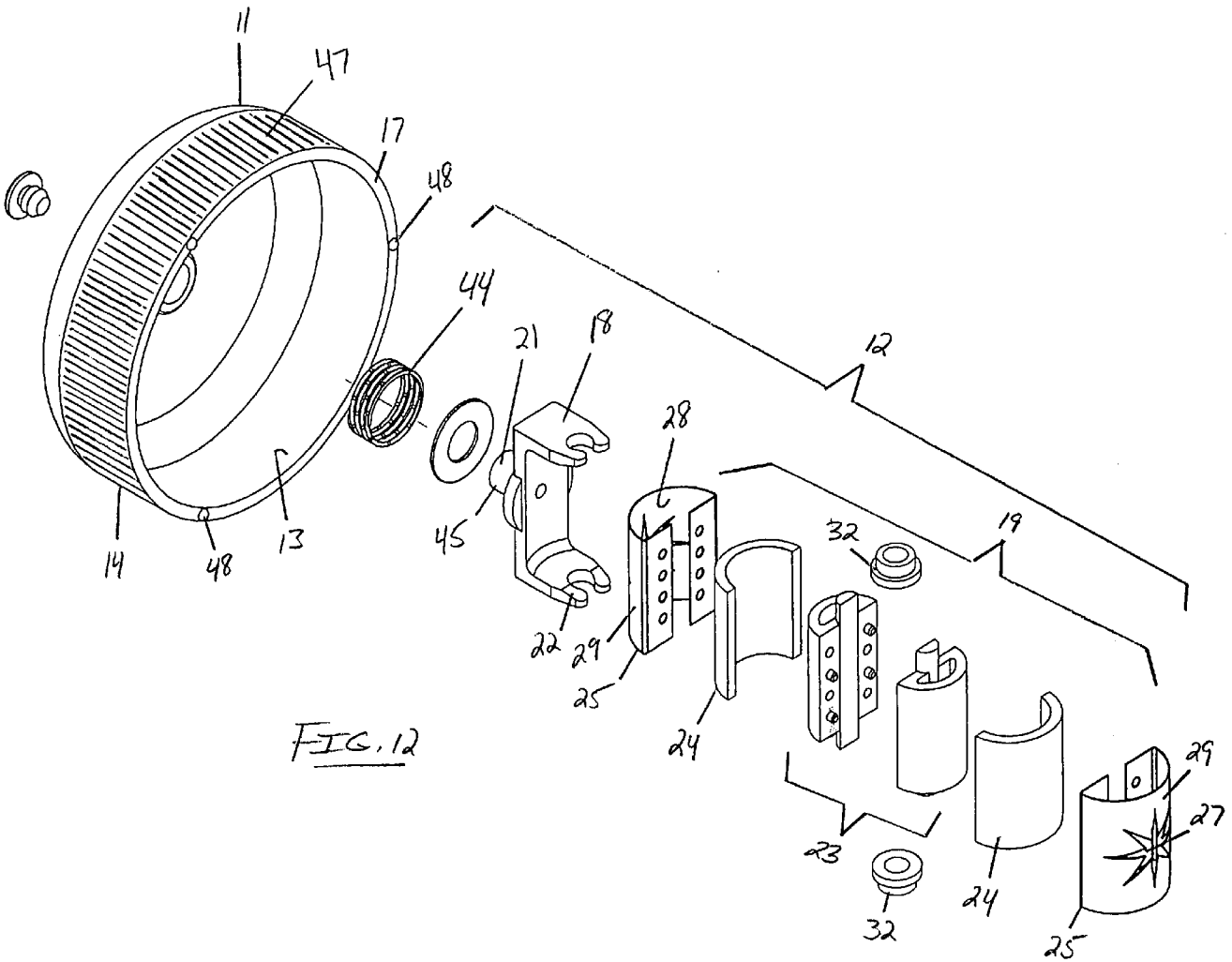
FIG. 12 is an enlarged exploded perspective view of the second alternative embodiment of the rolling marker assembly showing all structural components.

Outer casing surface 14 may comprise certain means for enhancing ones grip upon rolling marker assembly 10, which gripping means may be defined by a textured outer casing surface 47 or similar other means for enhancing one's grip thereupon as generally depicted in FIG. 12. Textured outer casing surface 47 thus enhances the user's ability to manually trace rolling marker assembly 10 adjacent marking surface 100. Inner casing surface 13 is preferably disposed in spaced (radial) adjacency to caster assembly 12 for enabling caster assembly 12 to rotate at least 360 rotational degrees about casing axis 15.

Caster assembly 12 preferably comprises a marker carriage 18 as illustrated and referenced in FIGS. 1–4, 6–8, and 10–15; a rotating pen assembly 19 as generally referenced in FIGS. 1–4, 6–8, 10–12, 14, and 15; and an overall caster assembly length 20 as generally referenced in FIG. 10. Marker carriage 18 preferably comprises a casing attachment member or portion 21 as illustrated and referenced in FIGS. 1–4, 6–8, and 10–12; and certain pen assembly-receiving means. The pen assembly-receiving means function to rotatably receive pen assembly 19 and in this regard, may preferably be defined by a bearing structure 22 or similar other bearing means as generally illustrated and referenced in FIGS. 6–8, 11, 12, and 15. When assembled, pen assembly 19 is preferably cylindrical in configuration as may be seen from a general inspection of FIGS. 1–4, 10, 11, and 14. Alternatively, however, pen assembly 19 may comprise an oval ball-shaped configuration (football or rugby ball-shaped) as may be seen from a general inspection of FIGS. 7 and 8. In any case, the transverse cross section of pen assembly should preferably comprise a closed arc length so that the assembly may be able to roll upon the marking surface 100 more effectively. Preferably, the closed arc length is circular for enabling more effective rolling movement thereof.

Figure 13:
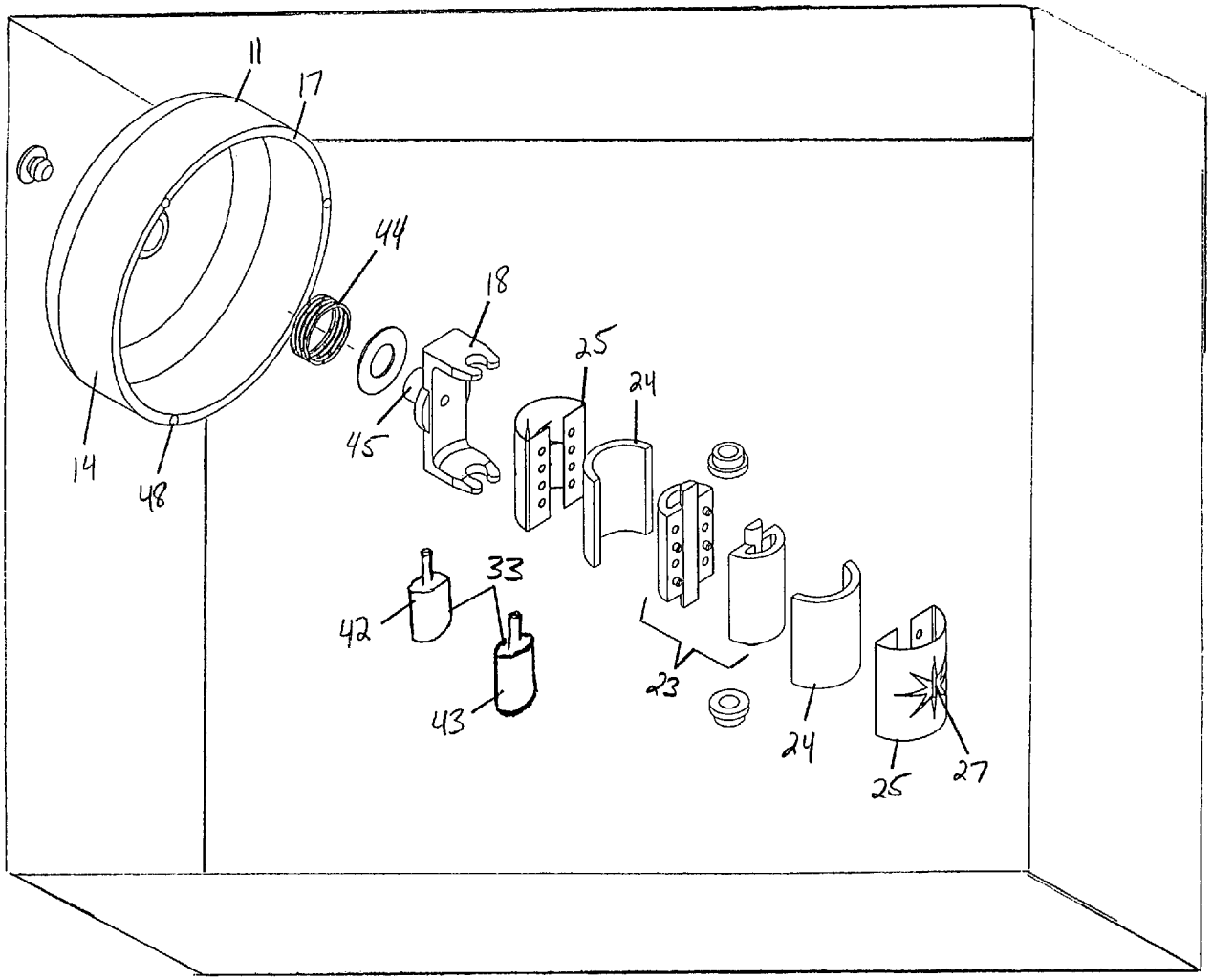
FIG. 13 is an exploded perspective view of the second alternative embodiment of the rolling marker assembly along two select ink sources as placed into a box for providing a rolling marker assembly kit.
Figure 14:
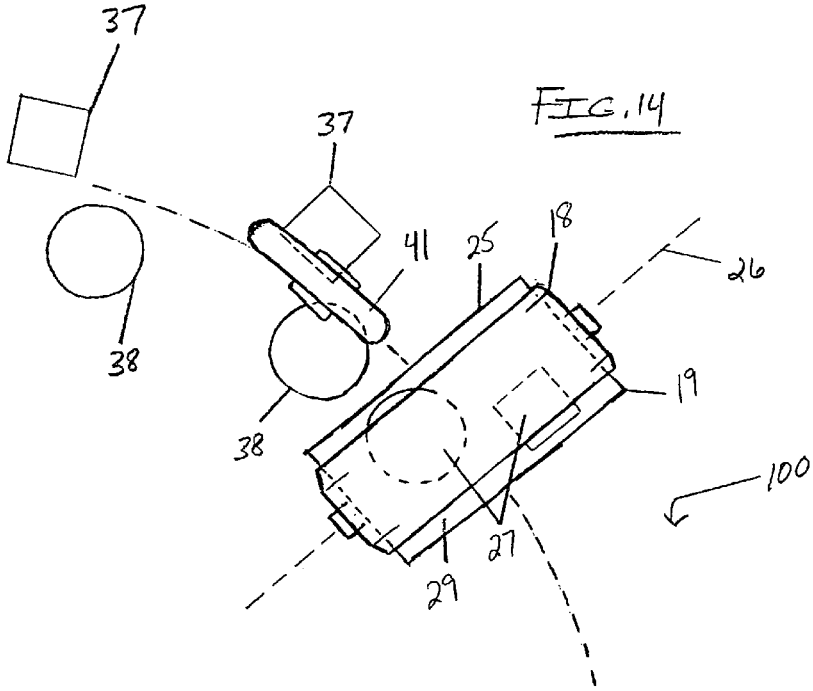
FIG. 14 is a fragmentary top view depiction of a cylindrical pen assembly as rotatably received in a marker carriage followed by a satellite guide wheel marking the marking surface with a non-linear serially-presented repeating pattern.
Figure 15:
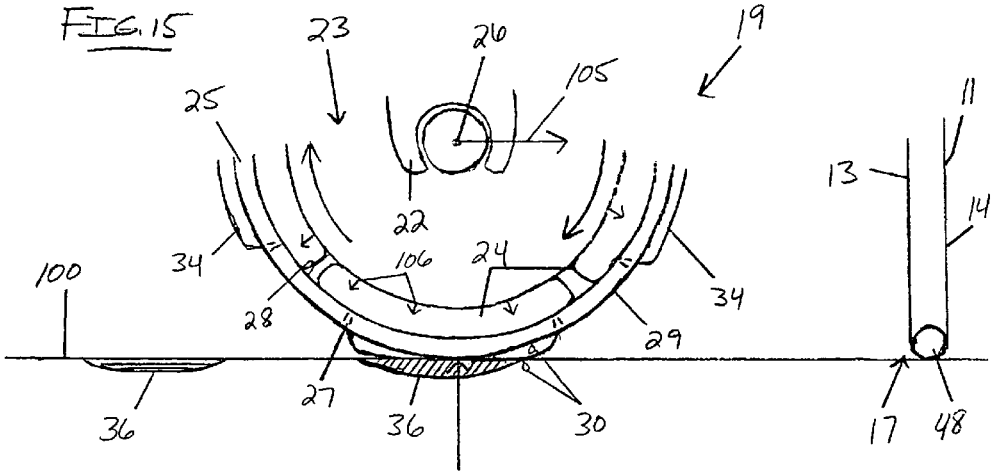
FIG. 15 is an enlarged fragmentary side view depiction of the preferred pen assembly as rotatably received in the marker assembly adjacent an outer shell casing and the marking surface depicting compression-releasable ink being deposited upon the marking surface thus marking the marking surface with pattern(s).
Figure 16:
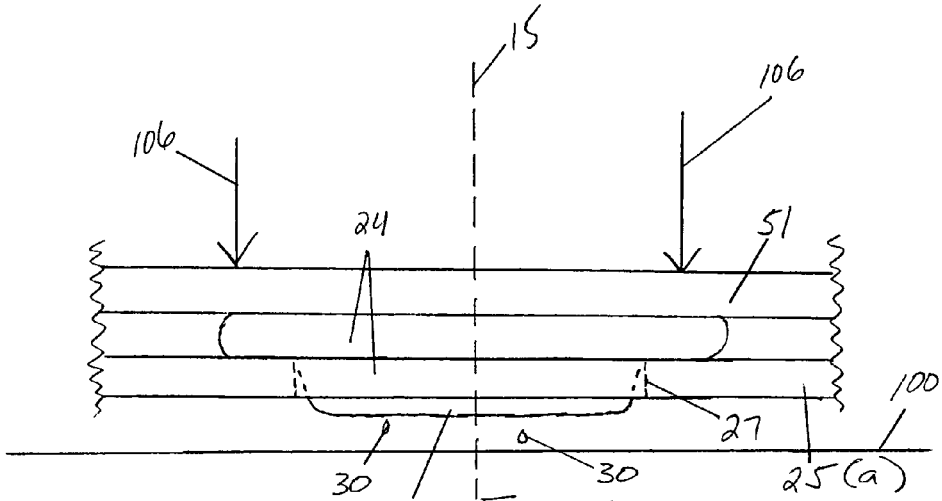
FIG. 16 is an enlarged fragmentary side view depiction of a third alternative embodiment of the marker assembly showing a substantially planar pad-compressing member, an ink-dispensing pad, and a substantially planar outer ink pad mask, the ink-dispensing pad being compressible by the pad-compressing member against the ink pad mask.

Pen assembly 19 preferably comprises comprising an inner pen core assembly 23 as generally illustrated and referenced in FIGS. 12, 13, and 15; a plurality of intermediate ink-dispensing pads 24 as illustrated and referenced in FIGS. 12, 13, and 15–17; a plurality of outer ink-masking or ink pad shells 25 as illustrated and referenced in FIGS. 11–15; and at least one marker rotation axis 26 as generally referenced in FIGS. 4, 7, 8, 14, and 15. In this last regard, it is contemplated that although the preferred pen assembly 19 is cylindrical in overall configuration, an alternative configuration for the pen assembly may be spherical. The contemplated spherical pen assembly (similar to that of a typical ball point) would necessarily be rotatably received in a socket type assembly-receiving means as formed with the marker carriage. However, rather than being limited to a single marker rotation axis, a spherical pen assembly could conceivably comprise an infinite number of rotation axes depending on the user's directed manual traceability as well as the interaction(s) between the pen assembly and the marking surface 100. Essentially, however, rolling marker assembly 10 and all the alternative embodiments thereof must comprise at least one marker rotation axis 26; the pen functioning by rolling adjacent the marking surface 100.

Inner pen core assembly 23 preferably comprising two cooperative semi-cylindrical core members as generally illustrated. In this regard, it will be seen from an inspection of FIGS. 12 and 13 that the cooperative semi-cylindrical core members comprise cooperative female and male structure (for example, holes and pins) for mating the two members. It will be understood that once assembled, the inner pen core assembly 23 inherently has a centroid (not specifically referenced) (which core centroid is also the centroid for pen assembly 19) and preferably comprises certain journaling means for cooperating with the bearing means. The journaling means may be defined in part, by certain core journal end caps 32, which caps 32 function to further retain the two semi-cylindrical members in cooperative assemblage as may be generally understood from a comparative inspection of FIGS. 11 and 12. It will thus be understood that the pen assembly-receiving means comprises certain bearing means and the pen assembly comprises certain journaling means, the bearing and journaling means being cooperatively associated with one another for enabling rotation about the marker rotation axis 26.

Ink-masking shells 25 each preferably comprise at least one patterned aperture 27 as illustrated and referenced in FIGS. 8, and 11–17; a concave inner shell surface 28 as generally referenced in FIGS. 12 and 15; and a convex outer shell surface 29 as generally referenced in FIGS. 1–4, 6–8 10–12, 14, and 15. Each ink-dispensing pad 24 is preferably impregnated with compression-releasable ink 30 (as referenced in FIGS. 15–17), which ink 30 comprises certain select coloration as may be chosen by the user. In this regard, it should be noted that certain ink sources 33 may be supplied with the rolling marker assembly so that the ink-dispensing pads 24 may be maintained or replenished with ink as needed. Certain generic ink sources 33 have been depicted in FIG. 13. Each ink-dispensing pad 24 is thus impregnated with a selectively-colored, compression-releasable ink as selected from the group consisting of a first color ink source 42 and at least one second color ink source 43 as generally referenced in FIG. 13. The rolling marker assembly 10 thus enables a user to mark multi-colored, serially-presented, repeating patterns.

The rotating pen assembly 19 is the rotatably received by the marker carriage 18 via the pen assembly-receiving means and thus, the pen assembly 19 is rotatable about the marker rotation axis 26. The caster assembly 12 is preferably rotatably attached to the casing 11 and thus, is preferably rotatable about the casing axis 15. The ink-dispensing pads 24 are compressibly sandwiched intermediate the outer ink-masking shells 25 and the inner pen core assembly 23. The ink-dispensing pads 24 thus form or comprise pattern-exposed portions 34 as illustrated and referenced in FIG. 15. The pattern-exposed portions 34 extend through the patterned apertures 27 and preferably comprise a substantially uniform exposed pad thickness 35 as generally referenced in FIG. 15.

Figure 2:
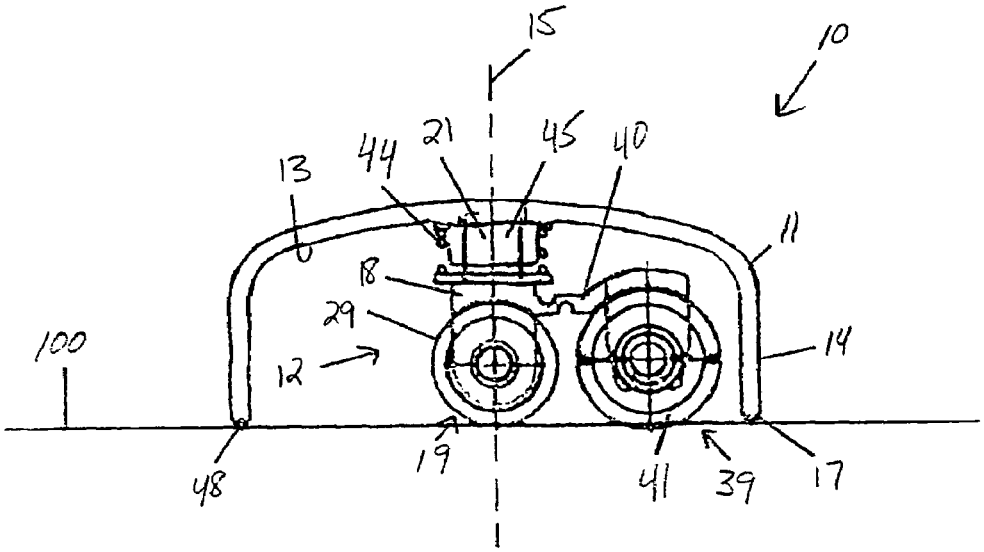
FIG. 2 is a fragmentary side view depiction of a second preferred embodiment of the rolling marker assembly with certain parts broken away to show otherwise hidden internal structures.
Figure 17:
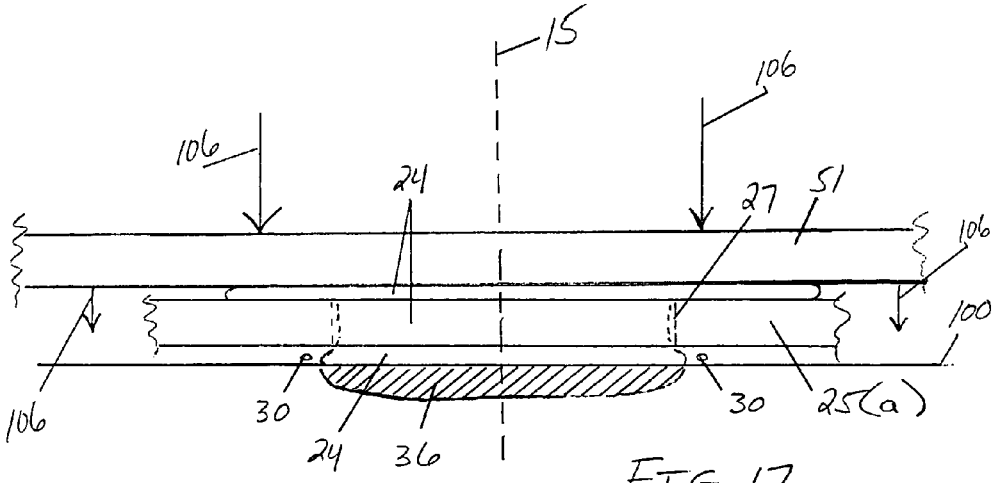
FIG. 17 is an enlarged fragmentary side view depiction of the third alternative embodiment of the marker assembly showing the pad-compressing member compressing the ink-dispensing pad against the ink pad mask, a pattern-exposed portion of the ink-dispensing pad being compressed against a marking surface for forming a pattern thereupon.

The difference between the caster assembly length 20 and the exposed pad thickness 35 is substantially equal to the casing height 16 so that the casing rim 17 and the outer shell surfaces 29 may be manually traceable adjacent the marking surface 100 as generally depicted in FIGS. 1, 2, and 15. In other words, the casing trim 17 and the outer shell surface 29 cooperatively contact the marking surface 100 as a means to enable compression of the pattern-exposed portions 34. As the pattern-exposed portions 34 are compressed (as generally depicted in FIG. 15) against or upon the marking surface 100, the compression-releasable ink 30 (or a similar other marking medium, such as paint, dye, lead, chalk, wax, oil, acid, bleach, and the like) is thus dispensed from the ink-dispensing pads 24 leaving behind certain patterns 36 as defined by the patterned apertures 27 as generally depicted in FIGS. 15 and 17. It will be recalled that pen assembly 19 is rotatable and with every complete revolution of at least 360 rotational degrees, a serial pattern is presented. For example, it will be seen from an inspection of FIG. 14, that a square 37 is first marked and then a circle 38 is marked upon the marking surface 100. Thus, the rolling marker assembly 10 enables a user to mark serially-presented, repeating patterns upon the marking surface 100.

The rolling marker assembly 10 may further preferably comprise certain means for guiding the rolling marker assembly or certain marker-guiding means for enabling the user to more effectively trace the caster assembly along the marking surface 100 as the user may elect. In this regard, it is contemplated that a dual caster assembly may function to enable the user to mark either linear patterns or non-linear patterns as the user may elect. The marker-guiding means may preferably be defined by a guide wheel assembly 39 as generally illustrated and referenced in FIGS. 1–4. Guide wheel assembly 39 preferably comprises a swivel type guide frame 40 as illustrated and referenced in FIGS. 1–4; and a guide wheel 41 as further referenced in FIGS. 1–5, and 14.

Figure 3:
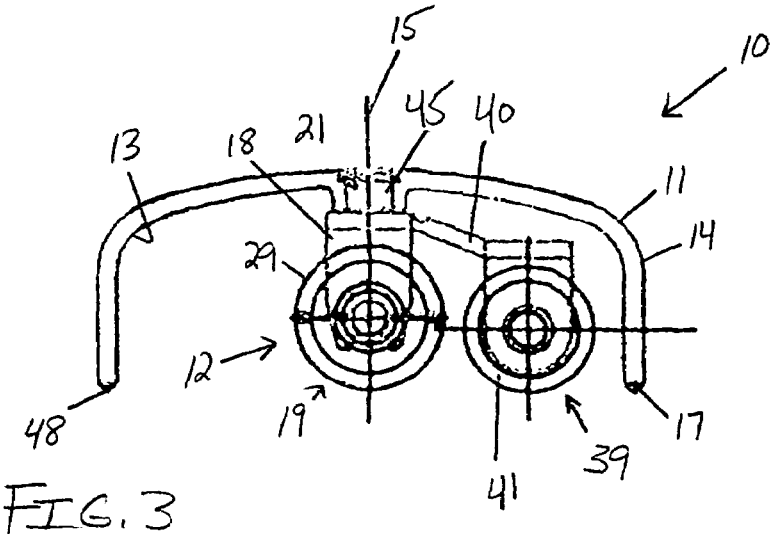
FIG. 3 is a fragmentary side view depiction of the first preferred embodiment of the rolling marker assembly with certain parts broken away to show an axial caster assembly and a satellite guide wheel assembly.
Figure 4:
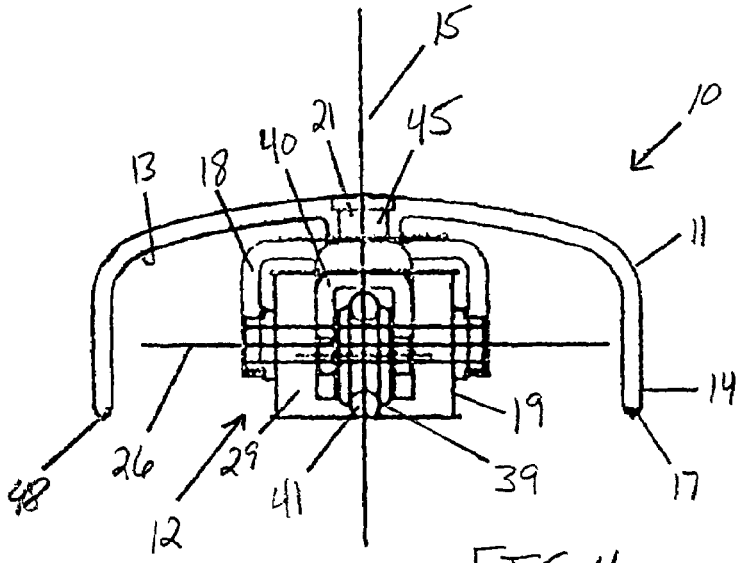
FIG. 4 is a fragmentary end view depiction of the first preferred embodiment of the rolling marker assembly with certain parts broken away to show the axial caster assembly and the satellite guide wheel assembly.
Figure 5:
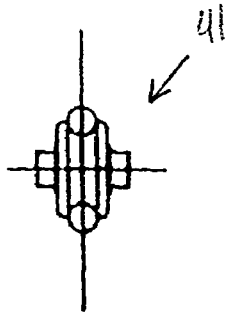
FIG. 5 is an end view depiction of a guide wheel of the guide wheel assembly shown in FIGS. 3 and 4.

Guide frame 40 is attached to rolling marker assembly 10 intermediate casing 11 and caster assembly 12 via a first frame end. Preferably, the first frame end is rotatably attached to caster assembly 12 such that guide frame 40 may freely rotate about casing axis 15. Guide wheel 41 is rotatably received by a second frame end for positioned placement adjacent the pen assembly 19. It is contemplated that guide wheel 41 may comprise a diameter either smaller in magnitude than the diameter of pen assembly 19 as generally depicted in FIGS. 1, 3, and 4 or greater in magnitude than the diameter of pen assembly 19 as generally depicted in FIG. 2. Guide wheel 41 is also manually traceable adjacent the marking surface 100 for guiding rolling marker assembly 10. It will thus be understood that the marker-guiding means being cooperatively associated with the caster assembly for guiding the rolling marker assembly, the marker-guiding means enabling the user to mark non-linear, serially-presented, repeating patterns as generally depicted in FIG. 14 or linear, serially-presented, repeating patterns as generally depicted in FIG. 8.

The rolling marker assembly 10 may further preferably comprise a compression coil 44 as illustrated and referenced in FIGS. 1, 2, and 10–13. It will be understood from an inspection of the noted figures that compression coil 44 extends intermediate marker carriage 18 and casing 11 in radial adjacency to casing axis 15 for enabling the user to impart a spring-returnable, casing-displacing force to rolling marker assembly 10. Casing 11 is thus displaceable relative to casing axis 15 under the spring-returnable, casing-displacing force. In other words, casing rim 17 is displaceable toward marking surface 100 relative to caster assembly 12. It is contemplated that casing rim 17 is displaceable toward marking surface 100 relative to caster assembly 12 for preventing foreign matter from contacting or otherwise interfering with caster assembly 12 during rolling marker assembly use. It is contemplated that when casing rim 17 comes into contact with marking surface 100, certain roller means for movement may function to ease the movement thereof. In this regard, it is contemplated that casing rim 17 may comprise certain rim-rolling means such as wheel assemblies or certain ball bearing type structure 48 as illustrated and referenced in FIGS. 1–4, 6, 7, 11–13, and 15. As is commonly understood, the rim-rolling means function to reduce friction intermediate casing rim 17 and marking surface 100 and thus, rolling marker assembly 10 requires less user-generated force to manually trace rolling marker assembly 10 adjacent marking surface 100. Casing rim 17 is displaceable away from marking surface 100 relative to caster assembly 12 for enabling the user to maintain or otherwise inspect caster assembly 12 during rolling marker assembly rest.

In the preferred embodiment, it is contemplated that marker carriage 18 comprises a substantially axial attachment member 45 as illustrated and referenced in FIGS. 1–4, 10, 12, and 13. Axial attachment member 45 is designed to mount or attach marker carriage 18 to casing 11 such that casing axis 15 and marker rotation axis 26 orthogonally intersect at a dual-axis point, the dual-axis point coinciding with the centroid. Pen assembly 19 is thus preferably biaxially rotatable about the dual-axis point. In other words, pen assembly 19 may rotate about marker rotation axis 26 and also rotate about casing axis 11.

Figure 6:
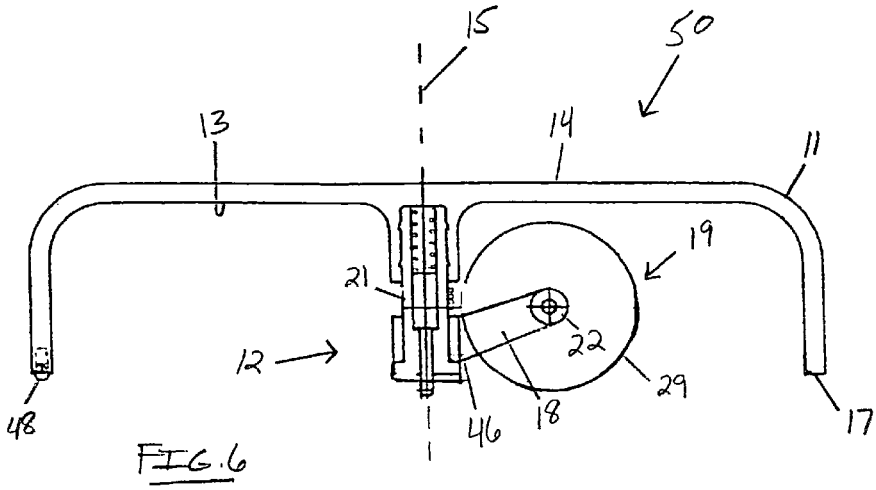
FIG. 6 is an enlarged fragmentary side view depiction of a first alternative embodiment of the rolling marker assembly with certain parts broken away to show an offset caster assembly.

In an alternative embodiment, however, it is contemplated that marker carriage 18 may comprise a certain offsetting attachment member 46 as illustrated and referenced in FIGS. 6–8. Offsetting attachment member 46 is designed to mount or attach marker carriage 18 to casing 11 such that casing axis 15 and marker rotation axis 26 are orthogonally spaced from one another. Pen assembly 19 of the alternative rolling marker assembly 50 is thus uniaxially rotatable about marker rotation axis 26 and marker rotation axis 26 of pen assembly 19 is rotatable about casing axis 15. It will thus be understood that marker carriage 18 comprises a select casing attachment member, the select casing attachment member being selected from the group consisting of axial attachment member 45 and offsetting attachment member 46. Axial attachment member 45 attaches marker carriage 18 to casing 11 such that casing axis 15 and marker rotation axis orthogonally intersect at a centroidal dual-axis point, pen assembly 19 being biaxially rotatable about the centroidal dual-axis point. Offsetting attachment member 46 attaches marker carriage 18 to casing 11 such that casing axis 15 and marker rotation axis 26 are orthogonally spaced from one another. Pen assembly 19 is thus uniaxially rotatable about marker rotation axis 26 and marker rotation axis 26 is rotatable about casing axis 15.

It is further contemplated that the present invention may be provided in the form of a novelty type kit for enabling a user to construct a rolling marker assembly of the type hereinabove specified. The rolling marker assembly kit thus comprises a constructable rolling marker assembly for marking at least one repeating pattern upon marking surface 100. The kit necessarily comprises casing 11, marker carriage 18, core assembly 23, at least one ink pad or ink-dispensing pad 24, a pad mask assembly or ink pad mask assembly (comprising ink-masking shells 25), and at least one ink source (such as ink sources (42 or 43). As previously specified, the ink source may be utilized for impregnating the ink pad with compression-releasable ink. The ink pad is sandwichable intermediate the core assembly 23 and the pad mask assembly for forming a pen assembly (such as pen assembly 19). The pen assembly is rotatably receivable by marker carriage 18 for forming caster assembly 12. Caster assembly 12 is attachable to casing 11 or outer shell for forming a rolling marker assembly.

It will be recalled that the pad mask assembly comprises at least one patterned aperture 27 for forming a pattern upon marking surface 100. In this regard, it is contemplated that the kit may comprise a great variety of interchangeable outer masking shells 25, each of which may comprise a different patterned aperture for enabling the user to create any number of fanciful patterns on marking surface 100. In this regard, for example, the patterned apertures 27 may comprise animal like footprint or paw print type templates 103 for marking a footprint or paw print type pattern 104 upon marking surface 100 as generally depicted in FIG. 8. It may thus be said that the pad mask assembly may comprise a plurality of select patterned apertures, the select patterned apertures being selected from the group consisting of a first fanciful pattern and at least one second fanciful pattern. The constructable rolling marker assembly thus enables the user to mark serially-presentable, repeatable patterns upon marking surface 100.

Being compressibly sandwichable intermediate core assembly 23 and the outer ink-masking shells 25, the ink pad comprises a pattern-exposable portion akin to pattern-exposed portion 34. The pattern-exposable portion is compressibly extendable through the patterned aperture 27. The rolling marker assembly is manually traceable adjacent marking surface 100 and the pattern-exposable portion is selectively compressible upon the marking surface 100 via the rotatably receivable pen assembly for dispensing ink therefrom. The constructable rolling marker assembly thus enables the user to mark a repeating pattern upon the marking surface 100.

Certain methodology is also inherently taught by the present invention. In this regard, it is contemplated that the present invention teaches a method for marking a pattern upon a marking surface, the method comprising a series of steps, including the provision of at least formed one ink pad mask (such as an ink pad shell 25), at least one compressible ink-impregnated ink pad (such as ink pad 24), and certain pad-compressing means (such as the cooperative assemblage intermediate inner pen core assembly 23 and outer pad mask assembly or a stamp plate 51 as illustrated and referenced in FIGS. 16 and 17). It will be recalled that the ink pad mask essentially comprises an arcuate transverse cross-section and at least one patterned-aperture 27 and thus comprises an inner concave mask surface (such as inner shell surface 28), an outer convex mask surface (such as outer shell surface 29), and an axis or rotation (such as marker rotation axis 26). After providing the noted structures, the user may then compress the ink pad against the inner concave mask surface adjacent the patterned aperture 27 via the pad-compressing means, the ink pad thereby forming a pattern-exposed portion 34, which extends through the patterned-aperture 27 adjacent the outer convex mask surface. The user may then roll the outer convex surface and the pattern-exposed portion 34 over marking surface 100 noting that the axis of rotation is displaceable parallel to marking surface 100 as generally referenced at 105 in FIG. 15. Given a preferred circular arcuate transverse cross-section, the axis of rotation will be translatably displaceable parallel to marking surface 100. In other words, if the outer convex surface is substantially circular, the axis of rotation will translate (move linearly) parallel to marking surface 100. After initiating the rolling step, the user compresses the pattern-exposed portion 34 against marking surface 100 thereby releasing compression-releasable ink upon the marking surface 100, the compression-releasable ink marking the marking surface 100 in the form of the pattern-exposed portion 27.

It will be recalled that the arcuate transverse cross-section of the outer convex surface is preferably closed (so as to enable at least one complete revolution thereof). The methodology thus teaches that the outer convex surface may be rotated about the axis of rotation at least 360 rotational degrees for repeatedly compressing the pattern-exposed portion 34 against marking surface 100 for marking repeating patterns upon marking surface 100. In this regard, it is contemplated that an aperture of miniscule magnitude may be defined by a single point pattern as formed in the pad mask. Given this type of arrangement, it is contemplated that a rotation of at least 360 rotational degrees will enable the user to repeat the pattern.

It will be further noted that the arcuate transverse cross-section (of outer convex surface) comprises a certain arc length, which arc length may comprise at least two patterned apertures 27 as generally depicted in FIGS. 8 and 14. It will be seen from an inspection of the noted figures that the two patterned-apertures 27 may be spaced from one another within the arc length. When the pattern-exposed portions 34 (as extended through the two patterned apertures 27) being compressed (as referenced at 106 in FIGS. 15–17) against marking surface 100, serially-presented patterns are marked upon marking surface 100.

Given a closed arcuate transverse cross section having a certain arc length comprising at least two patterned apertures 27 (spaced from one another within the arc length), the outer convex surface may be rotated about the axis of rotation more than 360 rotational degrees for repeatedly compressing the pattern-exposed portions 34 against marking surface 100. The repeatedly compressible pattern-exposed portions 34 may thus mark serially-presented, repeating patterns upon marking surface 100. In this regard, it will be noted that a rotation of more than 360 rotational degrees is necessary to effect a serially-presented, repeating pattern given that the two patterned apertures 27 are spaced form one another within the arc length.

Notably, at least one formable ink pad mask may be provided before providing the formed ink pad mask. This step is specified in order to distinctly point out that the user may go through a pattern selection process before actually providing a formed ink pad mask. Thus, it should be noted that a pattern form (such as a star, circle, square, or paw print) may be selected after providing at least one formable ink pad mask and at least one patterned aperture may be formed in the formable ink pad mask using the selected pattern form thus providing at least one formed ink pad mask.

While the above description contains much specificity, this specificity should not be construed as limitations on the scope of the invention, but rather as an exemplification of the invention. For example, as is described hereinabove, it is contemplated that the present invention essentially discloses a rolling marker assembly (such as rolling marker assemblies 10 and/or 50) for enabling a user to mark a pattern upon marking surface 100. The rolling marker assembly essentially comprises at least one compressible medium-dispensing pad (such as ink pad 24), at least one pad mask (such as ink-masking shell 25), at least one marker rotation axis, and certain pad-compressing means. The pad mask comprises at least one patterned aperture and the medium-dispensing pad is impregnated with a compression-releasable marking medium (such as paint, dye, lead, chalk, wax, oil, acid, bleach, and the like). The rolling marker assembly is rotatable about the marker rotation axis and the medium-dispensing pad is compressed against the pad mask via the pad-compressing means thus forming at least one pattern-exposed pad portion adjacent the patterned aperture. The rolling marker assembly is manually traceable adjacent marking surface 100 and the pattern-exposed pad portion is compressible upon marking surface 100 for dispensing the marking medium therefrom. The rolling marker assembly thus enables a user to mark a pattern upon marking surface 100. The rolling marker assembly may comprise a hand-holdable casing or outer shell, which casing inherently has a casing axis. The casing cooperatively encases the rolling marker assembly, which assembly is rotatable about the casing axis for enabling the user to mark certain non-linear pattern(s) upon marking surface 100.

Further, however, it is contemplated that the concepts of the present invention may be practiced without a rolling member or axis of rotation. In other words, if the outer ink pad mask were be formed in an alternative, substantially planar type ink pad shells 25(*a*)) as illustrated and referenced in FIGS. 16 and 17, and the pad-compressing means were to comprise a stamp plate 51 or similar other structure, then the ink pad mask of the structure could still comprise a patterned aperture, but no axis of rotation. Thus, conceivably, an ink-impregnated ink pad could be compressed against the ink pad mask for exposing certain pattern exposed portion(s) for marking individualized, non-repeating patterns upon the marking surface as generally depicted from a comparative inspection of FIGS. 16 and 17. For example a pattern-stamping assembly is contemplated whereby an ink pad may be compressed via certain stamping means against an ink pad mask to form or mark a pattern upon the marking surface and still fall within the scope of the present invention. Accordingly, although the invention has been described by reference to a preferred embodiment, it is not intended that the novel product, method or kit be limited thereby, but that modifications thereof are intended to be included as falling within the broad scope and spirit of the foregoing disclosure, the following claims and the appended drawings.

We claim:

1. A rolling marker assembly, the rolling marker assembly for enabling a user to mark serially-presented, repeating patterns upon a marking surface, the rolling marker assembly comprising a hand-holdable casing and a caster assembly, the casing comprising an inner casing surface, an outer casing surface, a substantially circular transverse casing cross-section, a longitudinal casing axis, a casing height, and a casing rim, the caster assembly comprising a marker carriage, a rotating pen assembly, and a caster assembly length, the marker carriage comprising a casing attachment member and pen assembly-receiving means, the pen assembly comprising an inner pen core, a plurality of intermediate ink-dispensing pads, a plurality of outer ink-masking shells, and at least one marker rotation axis, the inner pen core having a centroid, the ink-masking shells each comprising a patterned aperture and an outer shell surface, each ink-dispensing pad being impregnated with compression-releasable ink, the rotating pen assembly being rotatably received by the marker carriage via the pen assembly-receiving means, the pen assembly being rotatable about the marker rotation axis, the caster assembly being rotatably attached to the casing, the caster assembly being rotatable about the casing axis, the ink-dispensing pads being compressibly sandwiched intermediate the ink-masking shells and the pen core, the ink-dispensing pads comprising pattern-exposed portions, the pattern-exposed portions extending through the patterned apertures, the pattern-exposed portions comprising a substantially uniform exposed pad thickness, the difference between the caster assembly length and the exposed pad thickness being substantially equal to the casing height, the casing rim and the outer shell surfaces being manually traceable adjacent a marking surface, the pattern-exposed portions being compressible upon the marking surface for dispensing ink therefrom, the rolling marker assembly thus enabling the user to mark serially-presented, repeating patterns upon the marking surface.

2. The rolling marker assembly of claim 1 wherein the pen assembly-receiving means comprises bearing means and the pen assembly comprises journaling means, the bearing and journaling means being cooperatively associated for enabling rotation about the marker rotation axis.

3. The rolling marker assembly of claim 1 wherein the pen assembly is substantially cylindrical in configuration, the pen assembly thus comprising a longitudinal marker rotation axis, the pen assembly being rotatable about the longitudinal marker rotation axis for marking linear, serially-presented, repeating patterns.

4. The rolling marker assembly of claim 3 comprising a marker-guiding means, the marker-guiding means being cooperatively associated with the caster assembly for guiding the rolling marker assembly, the marker-guiding means enabling the user to mark non-linear, serially-presented, repeating patterns.

5. The rolling marker assembly of claim 4 wherein the marker-guiding means are defined by a guide wheel assembly, the guide wheel assembly comprising a guide frame and a guide wheel, the guide frame being attached to the rolling marker assembly intermediate the casing and the caster assembly via a first frame end, the guide wheel being rotatably received by a second frame end for positioned placement adjacent the pen assembly, the guide wheel manually traceable adjacent the marking surface for guiding the rolling marker assembly.

6. The rolling marker assembly of claim 5 wherein the guide frame is rotatably attached to the rolling marker assembly, the guide wheel assembly thus being rotatable about the casing axis.

7. The rolling marker assembly of claim 1 wherein each ink-dispensing pad is impregnated with a selectively-colored, compression-releasable ink, the selectively-colored, compression-releasable ink being selected from the group consisting of a first color ink source and at least one second color ink source, the rolling marker assembly thus enabling the user to mark multi-colored, serially-presented, repeating patterns.

8. The rolling marker assembly of claim 1 wherein the caster assembly comprises a compression coil, the compression coil extending intermediate the marker carriage and the casing in radial adjacency to the casing axis for enabling the user to impart a spring-returnable, casing-displacing force to the rolling marker assembly, the casing being axially displaceable relative to the casing axis under the spring-returnable, casing-displacing force.

9. The rolling marker assembly of claim 8 wherein the casing rim is axially displaceable toward the marking surface relative to the caster assembly for preventing foreign matter from contacting the caster assembly during rolling marker assembly use, the casing rim being axially displaceable away from the marking surface relative to the caster assembly for enabling a user to maintain the caster assembly during rolling marker assembly rest.

10. The rolling marker assembly of claim 1 wherein the marker carriage comprises select casing attachment member, the select casing attachment member being selected from the group consisting of a axial attachment member and a offsetting attachment member, the axial attachment member attaching the marker carriage to the casing such that the casing axis and the marker rotation axis orthogonally intersect at a dual-axis point, the dual-axis point coinciding with the centroid, the pen assembly being biaxially rotatable about the dual-axis point, the offsetting attachment member attaching the marker carriage to the casing such that the casing axis and the marker rotation axis are orthogonally spaced from one another, the pen assembly being uniaxially rotatable about the marker rotation axis, the marker rotation axis being rotatable about the casing axis.

11. The rolling marker assembly of claim 1 wherein the outer casing surface comprises gripping means and the inner casing surface is disposed in spaced radial adjacency to the caster assembly, the gripping means for enhancing a user's ability to manually trace the rolling marker assembly adjacent the marking surface, the inner casing surface enabling the caster assembly to rotate at least 360 rotational degrees about the casing axis.

12. The rolling marker assembly of claim 1 wherein the casing rim comprises rim-rolling means, the rim-rolling means for reducing friction intermediate the casing rim and the marking surface, the rolling marker assembly thus requiring less user-generated force to manually trace the rolling marker assembly adjacent the marking surface.

13. A rolling marker assembly kit, the rolling marker assembly kit enabling a user to construct a rolling marker assembly, the constructable rolling marker assembly for marking at least one repeating pattern upon a marking surface, the rolling marker assembly kit comprising:

a casing, a marker carriage, a core assembly, at least one ink pad, a pad mask assembly, and at least one ink source, the ink source for impregnating the ink pad with compression-releasable ink, the ink pad being sandwichable intermediate the core assembly and the pad mask assembly for forming a pen assembly, the pen assembly being rotatably receivable by the marker carriage for forming a caster assembly, the caster assembly being attachable to the casing for forming the rolling marker assembly, the pad mask assembly comprising at least one patterned aperture, the ink pad comprising a pattern-exposable portion, the pattern-exposable portion being compressibly extendable through the patterned aperture, the rolling marker assembly being manually traceable adjacent a marking surface, the pattern-exposed portion being selectively compressible upon the marking surface via the rotatably receivable pen assembly for dispensing ink therefrom, the constructable rolling marker assembly thus enabling the user to mark a repeating pattern upon the marking surface.

14. The rolling marker assembly kit of claim 13 comprising marker-guiding means, the caster assembly being rotatably receivable by the casing, the marker-guiding means being cooperatively associatable with the caster assembly for guiding the constructable rolling marker assembly, the marker-guiding means and the rotatably receivable caster assembly for enhancing the user's ability to mark non-linear repeating patterns upon the marking surface.

15. The rolling marker assembly of claim 14 wherein the marker-guiding means are defined by a guide wheel assembly, the guide wheel assembly comprising a swivel frame and a guide wheel, the swivel frame being attachable to the rolling marker assembly intermediate the casing and the caster assembly, the guide wheel being rotatably receivable by the swivel frame for positionable placement adjacent the pen assembly, the guide wheel being manually traceable adjacent the marking surface for guiding the constructable rolling marker assembly.

16. The rolling marker assembly kit of claim 13 comprising a selectively-colored, compression-releasable ink source, the selectively-colored, compression-releasable ink source being selected from the group consisting of a first color ink source and at least one second color ink source, the constructable rolling marker assembly thus enabling the user to mark multi-colored, repeating patterns upon the marking surface.

17. The rolling marker assembly kit of claim 13 wherein the pad mask assembly comprises a plurality of select patterned apertures, the select patterned apertures being selected from the group consisting of a first fanciful pattern and at least one second fanciful pattern, the constructable rolling marker assembly thus enabling the user to mark serially-presentable, repeatable patterns upon the marking surface.

18. The rolling marker assembly kit of claim 13 comprising a compression coil, the compression coil being insertable intermediate the marker carriage and the casing for enabling the user to impart a spring-returnable, casing-displacing force to the constructable rolling marker assembly, the casing being axially displaceable relative to the casing axis under the spring-returnable, casing-displacing force, the casing being axially displaceable toward the marking surface relative to the caster assembly for preventing foreign matter from contacting the caster assembly during rolling marker assembly use, the casing rim being axially displaceable away from the marking surface relative to the caster assembly for enabling a user to maintain the caster assembly during rolling marker assembly rest.

19. The rolling marker assembly of claim 13 wherein the marker carriage comprises select casing attachment member, the select casing attachment member being selected from the group consisting of a axial attachment member and a offsetting attachment member, the axial attachment member for attaching the marker carriage to the casing such that the casing axis and the marker rotation axis orthogonally intersect at a dual-axis point, the pen assembly being biaxially rotatable about the dual-axis point, the offsetting attachment member for attaching the marker carriage to the casing such that the casing axis and the marker rotation axis are orthogonally spaced from one another, the pen assembly being uniaxially rotatable about the marker rotation axis, the marker rotation axis being rotatable about the casing axis.

20. A marker assembly for enabling a user to mark a pattern upon a marking surface, the marker assembly comprising at least one compressible medium-dispensing pad, at least one pad mask, a hand-holdable casing, and pad-compressing means, the casing haying a casing axis and cooperatively encasing the medium-dispensing pad, pad mask, and pad-compressing means, the pad mask comprising at least one patterned aperture, the medium-dispensing pad being impregnated with a compression-releasable marking medium, the marker assembly being axially displaceable relative to the casing axis, the medium-dispensing pad of the axially displaced marker assembly being compressible against the pad mask via the pad-compressing means thereby forming at least one pattern-exposed pad portion adjacent the patterned aperture, the pattern-exposed pad portion being manually engageable with a marking surface, the pattern-exposed pad portion being compressible upon the marking surface for dispensing the marling medium therefrom, the marker assembly thus enabling the user to mark the pattern upon the marking surface.

* * * * *